US005314218A

United States Patent [19]

Nadherny

[11] Patent Number: 5,314,218

[45] Date of Patent: May 24, 1994

[54] HATCH COVER LOCK AND HINGE

[75] Inventor: Rudolph E. Nadherny, Naperville, Ill.

[73] Assignee: Ireco, Inc., Chicago, Ill.

[21] Appl. No.: 8,714

[22] Filed: Jan. 22, 1993

[51] Int. Cl.[5] ..... E05C 3/30; B63B 19/14

[52] U.S. Cl. ..... 292/256.5; 292/259 R; 292/11

[58] Field of Search ..... 292/DIG. 14, 11, 256.5, 292/31, 24, 37, 49, 259

[56] References Cited

U.S. PATENT DOCUMENTS

| | | | |
|---|---|---|---|
| 691,752 | 1/1902 | Dawley | 292/256.5 X |
| 768,530 | 8/1904 | King | 292/256.5 X |
| 3,848,912 | 11/1974 | Jensen et al. | 292/256.5 |
| 3,884,514 | 5/1975 | Praska | 292/256.5 X |
| 4,094,542 | 6/1978 | Siblik | 292/256.5 |
| 4,307,670 | 12/1981 | Nadherny | 292/256.5 X |

*Primary Examiner*—Richard E. Moore

*Attorney, Agent, or Firm*—Lockwood, Alex, Fitzgibbon & Cummings

[57] ABSTRACT

A hatch cover lock with an automatic first locking mechanism for securing a removable hatch cover of a railway hopper car to the railway hopper car and secondary manually operated locking mechanism to secure the hatch cover to the hopper car in addition to the automatic first locking mechanism which allows the hatch cover to be opened from either side of the hopper car, and which cooperates to prevent accidental removal of the hatch cover and/or batten bar from the hopper car.

25 Claims, 7 Drawing Sheets

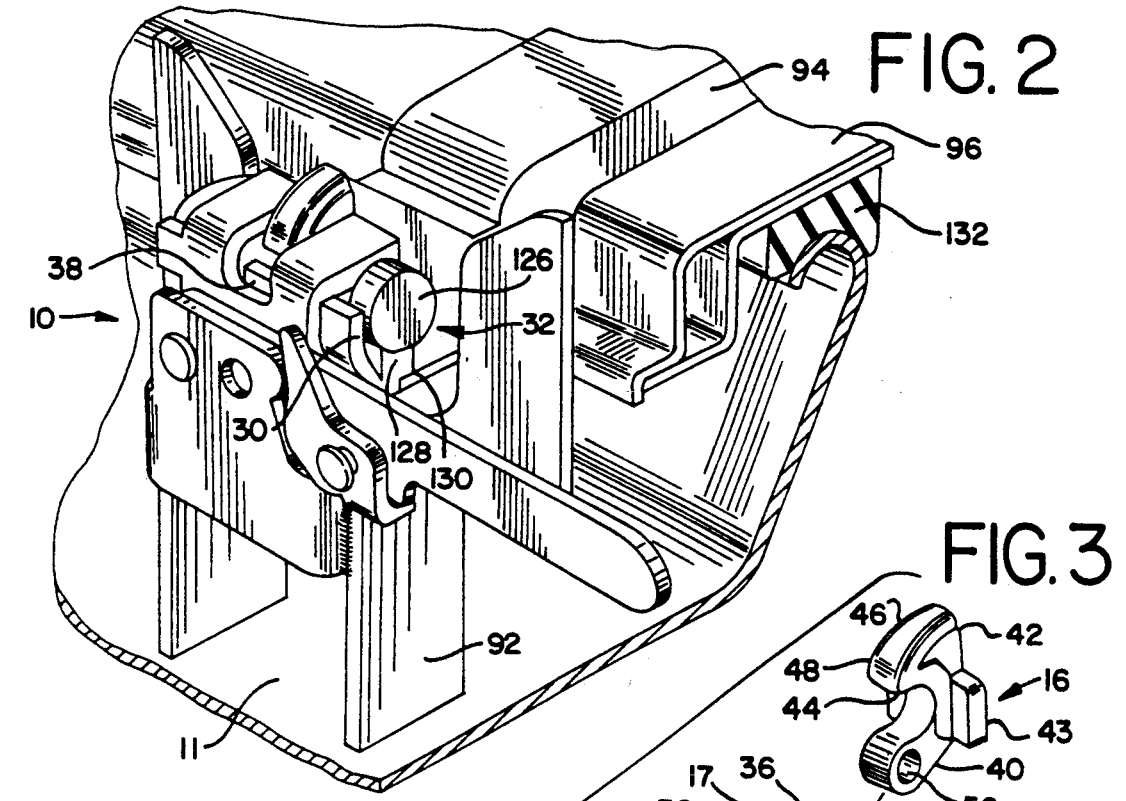
FIG. 2
FIG. 3
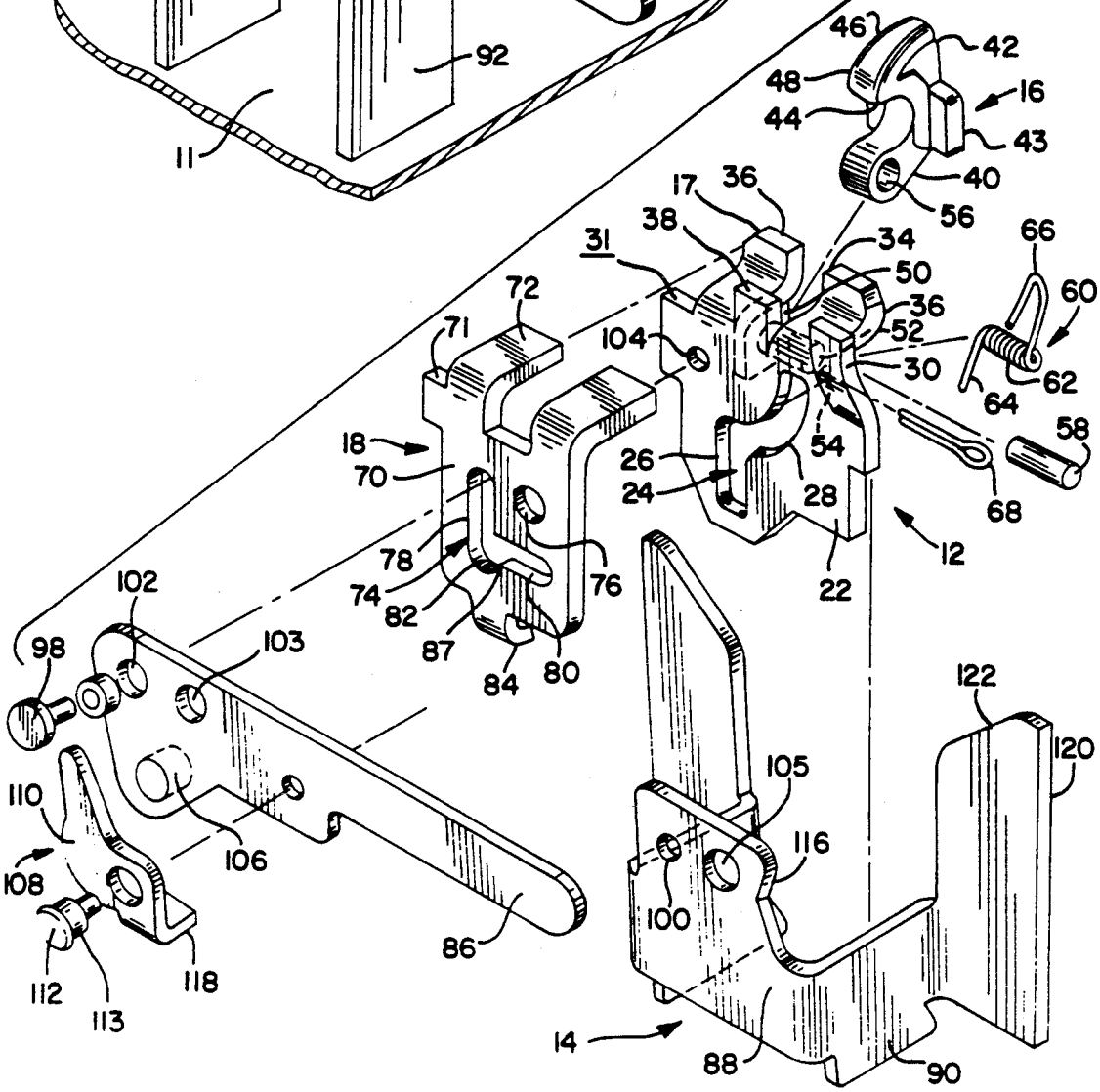

HATCH COVER LOCK AND HINGE

FIELD OF THE INVENTION

This invention relates generally to a hatch cover lock for securely attaching a cover to an open container and more particularly, a retainer hook with an automatic initial locking mechanism for securing a removable hatch cover of a railway hopper car to the railway hopper car and a secondary manually operated locking mechanism to further insure that the hatch cover is secured.

BACKGROUND OF THE INVENTION

Railway cars, of the type commonly referred to as covered hopper cars, are widely used by the railroad industry to transport various products throughout the country. These hopper cars are generally trough like cars having an interior storage area and openings in the top of the hopper called hatches to allow material to be transferred into the hopper. It is the general practice in the industry to load material into the hopper car through the hatch in the roof of the hopper car and subsequently remove the material from an opening in the bottom section of the hopper.

A single car may have several hatch covers that are used to close the openings in the top of the hopper car to prevent spillage and unwanted materials and infestation to enter the hopper car during transportation and storage of the material in the hopper car. The hatch may extend the entire length of he hopper car; therefore, it is generally desirable to have multiple hatch covers due to the unwieldy nature of single hatch. The hatch covers are generally planar sections that have a seal around their perimeter and are placed over the openings in the top of the hopper car for securely sealing the hatch opening of the hopper car during transportation.

The hatch covers are usually held down by one of two methods or a combination of both. One of such methods or devices utilized to secure the hatch covers to the hopper cars are hinged covers with batten bars that extend transversely across the hatch cover and are secured to the roof of the hopper car. The batten bars are generally narrow sheets of steel, aluminum or other relatively high strength material that are hinged at one end with a hinge pin assembly and held by a latch or locking device adjacent the hatch opening on the other end. The hinge pin assembly allows the batten bar to be swung away from a position overlying the hatch cover about an axis parallel to the top surface of the hopper car to allow opening of the hatch cover. A second method or mechanism for securing the hatch cover to the hopper car eliminates the need for batten bars by providing an overlapping lip on the cover. This approach also outfits the hatch cover with a hinge pin assembly so that it to may be rotated about an axis parallel to the top of the hopper car and secured thereto by a lock or latch.

Whichever approach is used, on either side of the hatch opening into the hopper car is an area generally designated as a walkway for railroad personnel to allow the personnel to move about the top of the car. A major drawback with prior art safety hooks is that often times the hatch cover and the batten bar are hinged to open on opposite sides of the hatch opening thus obstructing both walkways on either side of the hatch opening. This creates additional work for the railroad personnel as they are required to continually traverse the hatch opening in order to unlock the batten bars and hatch covers. In addition, the continual crossing of the hatch opening by railroad personnel to get to the latches can create Potential safety problem as well.

In order to cover such a large opening with a hatch cover that is manageable by railroad personnel it is well known to use a series of hatch covers to cover a single opening. The use of a series of hatch covers however requires that each individual hatch cover be secured to the roof of the hopper car and each joint between adjacent hatch covers be secured. This has been accomplished in the past by utilizing a variety of adjacent locking devices for holding the batten bar and hatch cover hinge pins in a secure manner.

This series of locks securing the hatch cover led to another major problem with the prior art locking devices for holding the batten bar hinge and the hatch cover hinge. The hatch cover is outfitted with a seal gasket of a resilient nature, thus, when the hatch cover is in its locked position compressing the seal, the seal about the periphery of the hatch cover supplies an upward force on the hatch cover. Therefore, when a hatch hinge or a batten bar hinge was unlocked by railroad personnel, such personnel should be careful to avoid potential injury from the hatch popping open and upward due to the force from the compressed resilient seal.

A problem associated with prior locking assemblies for the hatch covers is the possibility for the hatch cover to be accidentally left unsecured. For example, if the hatch hinge or the batten bar hinge section is not locked down with the hatch cover in its closed position this can create circumstances where the hatch cover has a tendency to fly off of the hopper car after the train is moving.

SUMMARY OF THE INVENTION

The hatch cover lock of the present invention overcomes the deficiencies of the prior art to effectively provide a retainer hook for batten bars and hatch cover hinges for securing a removable roof member to a railway hopper car.

The retainer hook according to the present invention includes a saddle carried on an inner housing. An offset hinge pin is included and adapted to be connected to the removable hatch or the batten bar and adapted to seat in the saddle. The present invention also includes a first automatic locking means in the form of a retainer hook with a trunnion pin carried by the inner housing for securing the hinge pin in the saddle. The retainer hook preferably is biased by a spring member in a first position overlying the saddle and is adapted to be pivoted to a second position allowing the hinge pin ingress and egress into the saddle. The present invention further preferably includes a second locking means for further securing the hinge pin in the saddle in the form of a hatch lock mechanism carried on an outer housing wherein the outer housing is connected to the inner housing and securely mounted on the roof of the hopper car. The hatch lock mechanism typically includes a keeper juxtaposed to the inner housing and guided for translatory and pivotal movement thereon. The keeper can also include a pair of laterally extending cover straps overlying the saddle when in a latched position. A pivotable handle is provided, typically pivoted on the outer and inner housings between the keeper and the outer housing to cooperate with the keeper for shifting the pair of cover straps between a latched position and an unlatched position where the cover straps are pivotally and translatorily displaced from the latched position.

It is therefore a general object of the present invention to provide an improved hatch cover lock for batten bars and/or hatch cover hinges for securing a removable roof member to a railway hopper car which overcomes the limitations and deficiencies of the prior art.

It is a further object of the present invention to provide a hatch cover lock for batten bars and/or hatch cover hinges which automatically locks a hatch cover in a closed position.

Yet another object of the present invention is a hatch cover lock for batten bars and/or hatch cover hinges that allows the hatch cover and batten bar, when provided, to be opened from either side of the hatch opening in the hopper car.

These and other objects, advantages and features of the present invention will become apparent from the following description of the preferred embodiment of the present invention considered in conjunction with the accompanying drawings.

BRIEF DESCRIPTION OF THE DRAWINGS

For a more complete understanding of the present invention reference should now be made to the embodiments illustrated in greater detail in the accompanying drawings and described below by way of example of the invention. It should be understood that the invention is not necessarily limited to the particular embodiments illustrated herein but is defined by the appended claims.

FIG. 2 is a perspective view of the hatch cover lock for batten bars made according to the present invention illustrating the hatch cover lock and a batten bar in a latched position;

FIG. 3 is an exploded perspective view of the hatch cover lock illustrated in FIG. 2;

DESCRIPTION TO THE PREFERRED EMBODIMENTS

Figure 1:
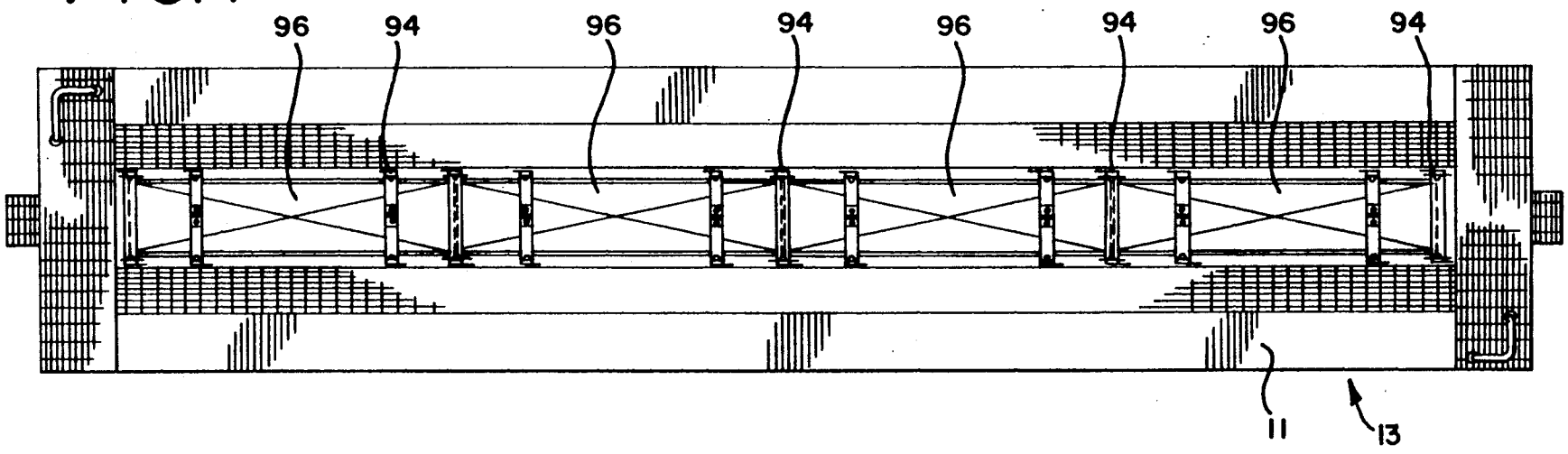
FIG. 1 is a top plan view of a railway hopper car with hatch covers held down by batten bars and hatch cover hinges.

A hatch cover lock assembly generally in accordance with the invention generally designated 10 is shown in FIG. 2 mounted on the roof 11 of a hopper car 13 as including several principal parts. As perhaps best shown in FIG. 3, the hatch cover lock assembly 10 includes an inner housing 12, an outer housing 14, a first latching means in the form of a retainer hook 16, a second latching means in the form of a keeper 18, and a handle 86.

The inner housing 12 includes a generally planar plate 22, preferably made of steel, having a slot 24 with a substantially straight portion 26 and a substantially arcuate portion 28. Extending from the upper edge of the inner housing 12 is an angled flange or stabilizer 30. The stabilizer 30 is angled outwardly and upwardly from the inner housing 12 to assist in aligning a hinge pin 32 (FIG. 2) in the latch assembly 10 and cooperates with an additional stabilizer 31 to prevent undue rotation of the hinge pin 32 about a vertical axis when secured in the saddle in the unlatched position.

Integral with and arcuately extending from the upper edge of the planar plate 22 is a saddle 34 which forms an area complementary to a cylindrical hinge pin extending longitudinally across the saddle 34. The complementary area is formed by the saddle 34 which includes a pair of curved flanges 36 and a shorter straight and upwardly extending retaining flange 38.

The hatch cover lock 10 also includes a first automatic latching means including a retainer hook 16. The retainer hook 16 shown in FIGS. 2 and 3 has a lower hook body 40 and an upper hook portion 42. The upper hook portion includes generally planar inner surface 44 and an outer hook surface 46. Outer hook surface 46 is generally curvilinear. The lower hook body 40 includes a bore 56 extending therethrough to accept a trunnion 58. The trunnion may also comprise an integral portion of the lower hook body. The retainer hook 16 also includes stops 43 that prevent rotation of the retainer hook beyond a substantially upright position.

Figure 5:
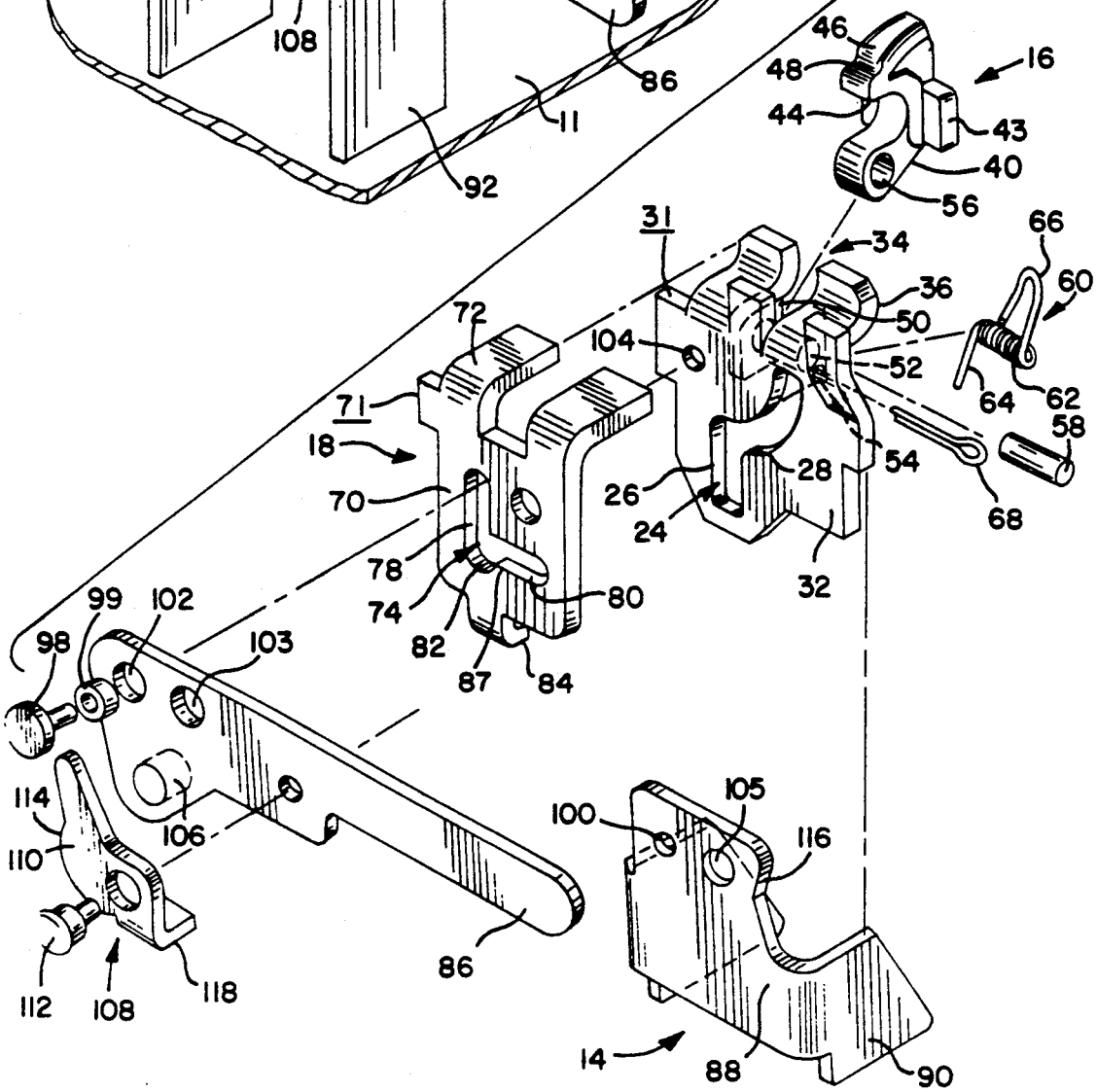
FIG. 5 is an exploded perspective view of the hatch cover lock illustrated in FIG. 4.
Figure 8:
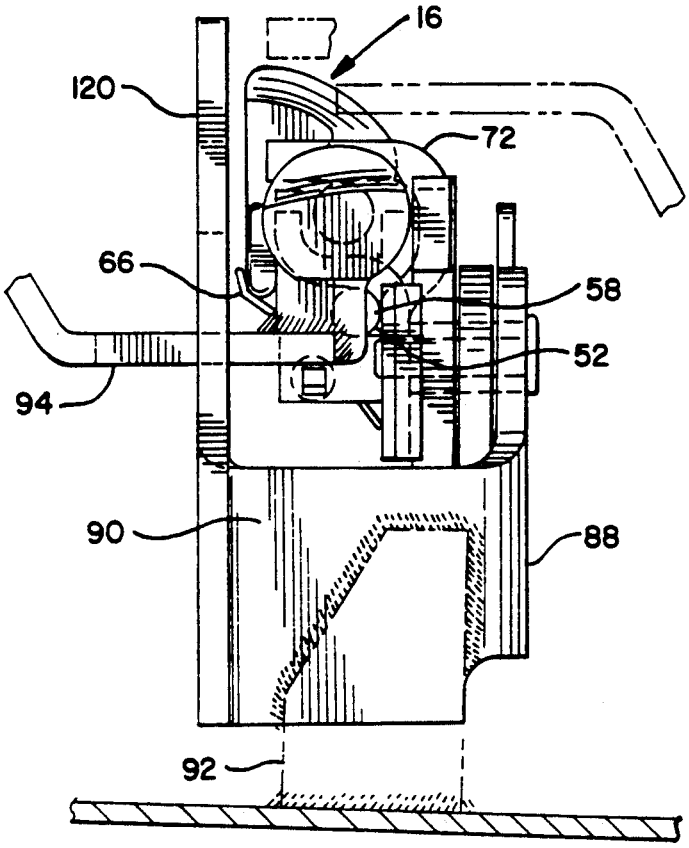
FIG. 8 is a side elevational view of the hatch cover lock of FIG. 6.

A generally U-shaped hook housing 50 is attached to the back surface of the inner housing 12 and the bottom surfaces of each of the curved flanges 36 preferably by welding. An upper section on either side of the U-shaped member 50 is cut-away forming a longitudinal pathway 52 as shown in FIGS. 3, 5 and 8 bound by the U-shaped hook housing 50, the back surface of the inner housing 12 and the bottom surface of the curved flanges 36. The U-shaped hook housing 50 further includes a bore 54 extending longitudinally therethrough.

The retainer hook 16 is disposed generally between the curved flanges 36 of the saddle 34 such that the bore 56 or the integral trunnion 58 extending through the lower hook body 40 is coaxial with the longitudinal pathway 52. Once positioned as such, the trunnion 58 may be inserted in the longitudinal pathway 52 and through the bore 56 forming an axis about which the retainer hook 16 may rotate. The trunnion 58 may alternatively be formed integrally with the retainer hook 16.

The upper hook portion 42 is biased over the complementary area formed in the saddle 34 by a torsion spring 60. The torsion spring 60 includes a coiled body section 62, a downwardly extending arm 64, and an upwardly extending looped arm 66. The spring 60 is disposed between the U-shaped hook housing 50 such that a cotter pin 68 may be inserted through bore 54 and the coiled body section 62 of the spring to hold the spring in place. It is preferred that the spring be made of stainless steel or similar material. When the spring 60 is disposed as described, the downwardly extending arm 64 engages the back surface of the inner housing 12 and the upwardly extending looped arm 66 engages the back of the retainer hook 16. The looped arm 66 provides a wider surface engaging area against the back surface Of the retainer hook 16 that more securely biases the retainer hook 16 over the complementary area of the saddle 34.

The hatch cover lock 10 further includes a second locking means in the form of a keeper 18. The keeper 18 is a generally planar member 70 having a pair of integral cover straps 72 which extend generally perpendicularly from the planar member 70. The planar member 70 further includes an L-shaped slotted section 74 and a cylindrical bore 76 extending therethrough. The slot 74 comprises a vertical arm 78 and a horizontal ar 80. At the juncture between the arms is a notch 82. In addition, a follower flange 84 extends perpendicularly from the Planar member 70 on an edge opposite the cover straps 72.

Figure 4:
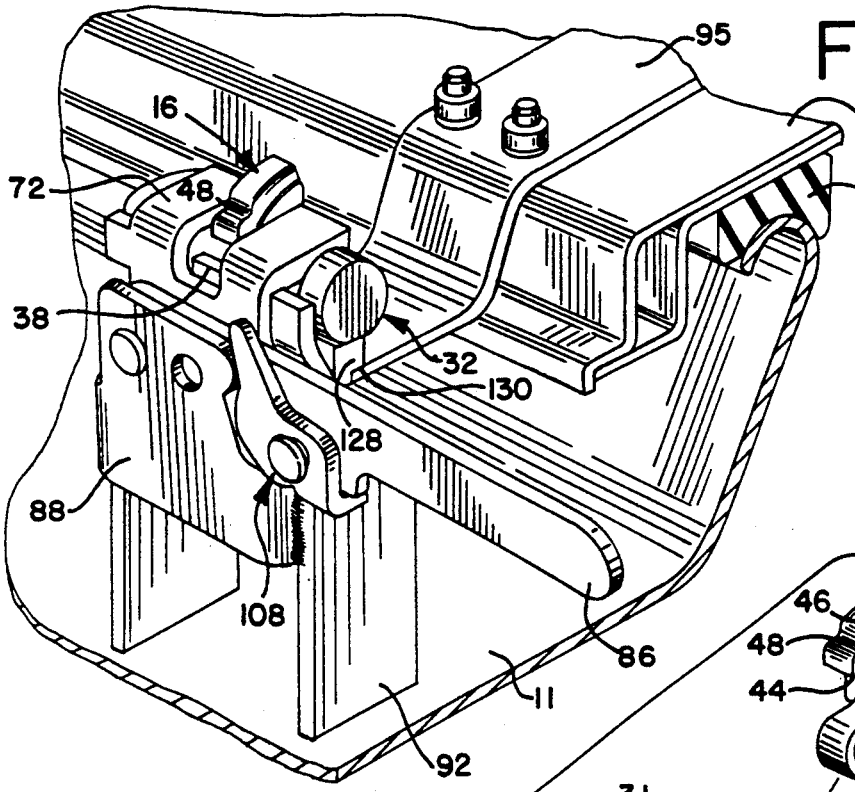
FIG. 4 is a perspective view of the hatch cover lock for hatch hinges made according to the present invention illustrating the hatch cover lock and a hatch cover hinge in a latched position.
Figure 9:
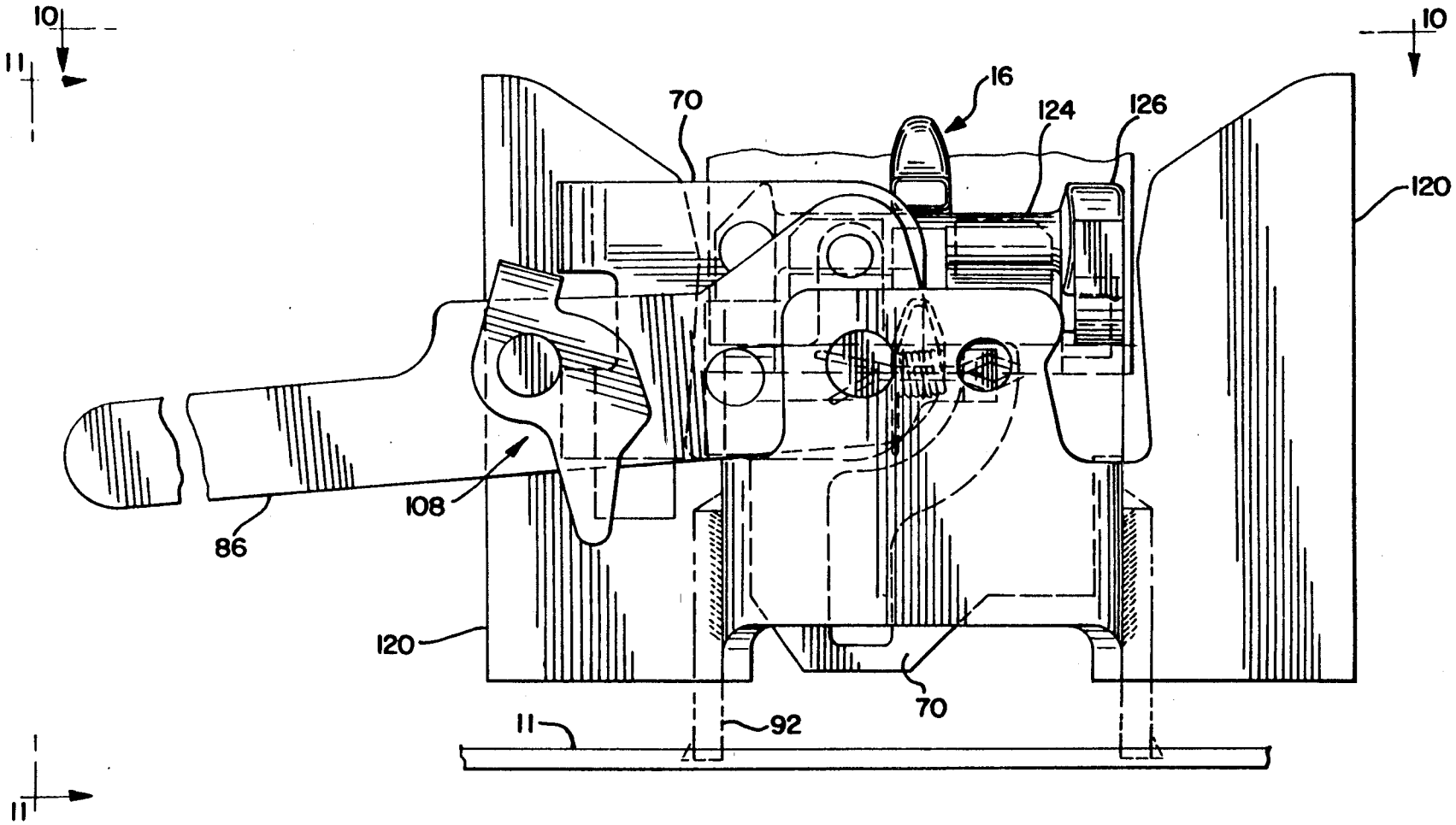
FIG. 9 is a front elevational view of a hatch cover lock made according to the present invention shown in the unlatched position.

The cover straps 72 are Pivotally and translatorily moveable with respect to the inner housing 12 between a latched Position and an unlatched Position. The latched position of the hatch cover lock 10 is illustrated in FIG. 4 wherein the spaced apart cover straps 72 extend over the complementary area formed in the saddle 34. In the unlatched position shown in FIG. 9 the cover straps are raised upwardly from the latched position and rotated approximately goo.about a horizontal axis.

The follower flange 84 of the keeper 18 extends into the slot 24 in the inner housing 12. The follower flange 84 moves in an arcuate path when guided by the arcuate portion 28 of the slot 24 and then moves in a vertical direction when engaged to the straight Portion 26 of the slot. The keeper engaged to the straight portion 26 of the slot. The keeper also includes a stabilizer 71 which cooperates with stabilizer 30 when the hatch cover lock is in the latched position to prevent undue rotation of the hinge pin 32 about a vertical axis when positioned in the saddle.

Movement of the keeper 18 is effected by engagement from a handle 86. The handle 86 and the keeper 18 are mounted for rotational and translatory movement between the inner housing 12 and an outer housing 14. The outer housing 14 is shown in FIG. 5 as a generally planar steel section 88 having inwardly turned leg portions 90. The inner housing 12 is mounted preferably by welding to the inner walls of each of the inwardly turned leg portion 90. The outer housing 14 may be mounted between a bracing section 92 on the roof of a hopper car 13 as shown in FIG. 4 or directly to the roof 11 of the hopper car. When mounted to the bracing 92, the leg portions 90 are of sufficient length and have enough space below the handle 86 and the keeper 18 to allow some vertical adjustment when mounting the hatch cover lock 10 to the hopper car to accommodate the hinge pin 32 of a batten bar 94 or hatch cover 96.

For mounting the keeper 18 and the handle 86 between the inner and outer housings, there is provided a pivot member which may be in the form of a tubular rivet 98. The tubular rivet 98 is arranged to extend into a bushing 99 and through an opening 100 in the outer housing 14, an opening 102 in the handle 86, the vertical arm 78 of the keeper 18 and an opening 104 in the inner housing 12. When assembled, the end of the rivet 98 extending into the inner housing is headed over to secure the rivet.

The handle 86 is provided with an integral detent 106 that rides in the slot 74 of the keeper 18 to effect movement of the keeper. The handle 86 also includes a gravity lock 108 for positively locking the handle 86 in the latched position. The gravity lock 108 includes a plate 110 having an opening for securing a rivet 112 and associated bushing 113 to attach the plate to the handle. A protrusion 114 on the plate 110 is arranged to engage a boss 116 on one side of the outer housing 14 to hold the handle 86 against counterclockwise movement to the unlatched position. The plate 110 is held in the locked position by gravity. The rotation of the plate 110 is limited in both clockwise and counterclockwise directions by an integral flange 118 inwardly turned to engage the lower edge of the handle 86. The handle is also provided with a bore 103 which cooperates with bore 105 of the outer frame, bore 76 on the keeper and slot 24 of the inner housing to provide a pathway for the utilization of a breakable tamper band inserted therethrough to indicate whether the hatch cover lock 10 has been unlatched.

It is preferred that the outer housing 14 of the hatch cover lock be constructed as illustrated in FIG. 5, particularly when the retainer hook 16 is used to lock the hinge pin 32 of a hatch cover 96. Alternatively, the outer housing 14 may include winged batten bar centering guides 120 as illustrated in FIGS. 2 and 3. The winged portion of the batten bar centering guides 120 includes two inwardly sloped camming surfaces 122 which help to guide the hinge pin 32 into engagement with the saddle 34. The centering guides 120 are particularly helpful when locking a hinge pin of a batten bar 94 due to the tendency of the batten bar 94 to have more lateral play. In addition, the curved flanges 36 includes chamfered edges 17 of approximately 45° to further assist in centering the hinge pin into the saddle 34.

In operation, the retainer hook 16 is capable of automatically locking a hinge pin 32 and then further securing the hinge pin in the hatch cover lock 10. The hinge pin 32 may be carried by either the hatch cover hinge strap 95 as shown in FIG. 4 or a batten bar 94 as shown in FIG. 2. A series of hinged hatch covers 96 and batten bars 94 may be utilized to completely cover a hatch opening of a hopper car as shown in FIG. 1. It is preferred that the batten bar 94 and hatch cover 96 be hinged on both sides. When a hatch cover lock constructed according to the present invention is utilized on both hinge pins the batten bar or hatch cover may be selectively pivoted about either hinge pin. With one hinge of the hatch cover locked, an operator may pivot the hatch cover about the locked hinge bringing the free hinge pin attached to the hatch cover toward the hatch cover lock 10 in an arcuate path. It should be understood that the hatch cover lock 10 works substantially the same whether a hinge pin 32 carried by hatch cover hinge strap 95 or a batten bar 94 is being secured.

Figure 11:
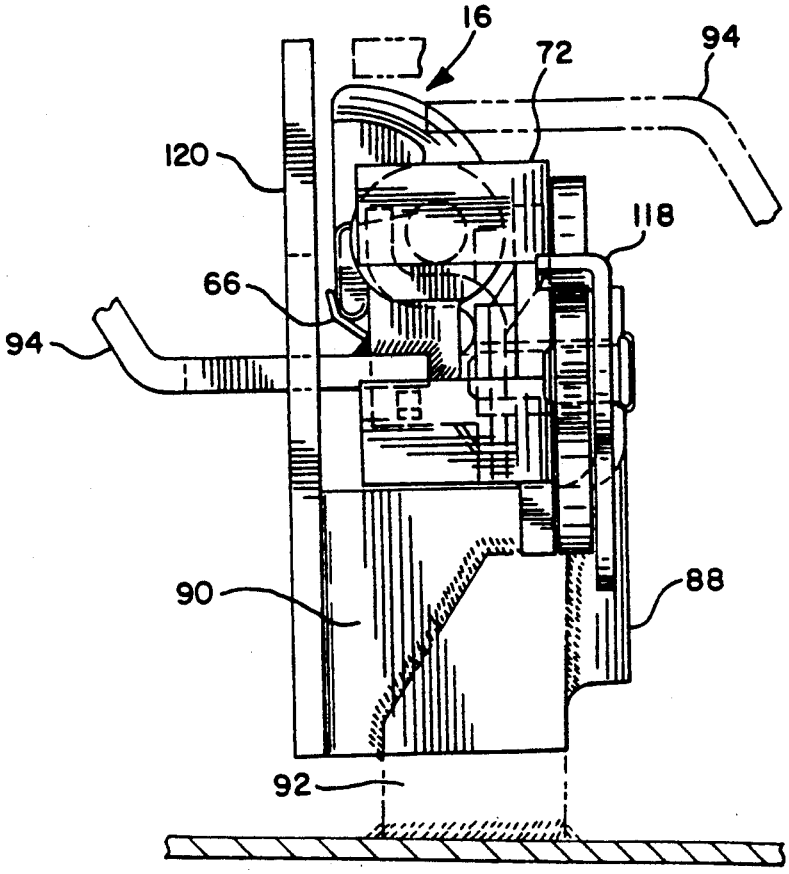
FIG. 11 is a side elevational view of the hatch cover lock of FIG. 9.

The hinge pin 32 is generally welded to a hatch cover hinge strap 95 that is fixedly attached to the hatch cover as in FIG. 4. Alternatively, the hinge pin 32 may be welded to a batten bar 94 as in FIG. 2 wherein the batten bar is not fixedly attached to the hatch cover 96 and therefore does not carry the weight of the hatch cover when pivoted about either of its hinge pins. The hinge pin is provided with a cylindrical pin body 124 and enlarged cylindrical pin ends 126 having a downwardly extending flange 128 with a cutaway portion or locator lip 130 for attaching the hinge pin to the batten bar 94 or hatch cover hinge strap 95. The hinge pin 32 is offset so that the batten bar 94 may be rotated about the hinge pin 32 when the hinge pin is in the latched position as in FIG. 8, and when in the unlatched position and only held by the retainer hook 16 as in FIG. 11.

When either a batten bar or hatch cover is rotated about a locked hinge pin the other hinge pin 32 approaches the hatch cover lock 10 and the cylindrical pin body 124 engages the outer hook surface 46 of the retainer hook 16. The retainer hook 16 is rotated out of the pathway of the hinge pin about the trunnion 50 due to the force of the pin body 124 acting against the outer hook surface 46. With the retainer hook 16 rotated out of the way, the hinge pin 32 is given access to the saddle 34 and seated therein on the complementary area formed by the curved flanges 36 and the retainer flange 38.

The retainer hook 16, returns to its original position overlying the saddle 34, due to the force exerted on it by the torsion spring 60, thereby securing the hinge pin 32 in the saddle and preventing its exit therefrom. On a hatch cover lock utilized to secure a batten bar it is preferred that the torsion spring supply a force of between 10 to 15 pounds on the retainer hook 16. On a hatch cover lock utilized to secure a hatch cover, it is preferred that the torsion spring supply a force of between 20 to 30 pounds on the retainer hook 16. It is preferred that the torsion spring have sufficient force on the retainer hook 16 which allows the hinge pin 32, if carried on the hatch cover hinge straps 95, to be locked in place by the weight of the hatch cover with very little assistance from the railroad personnel. The spring 60 may also act as a shock absorber reducing the impact of the hinge pin on the hatch cover lock.

As is practiced in the art, the hatch cover as shown in FIGS. 2 and 4 include a resilient coaming seal 132. Thus when the hinge pin is initially locked in the hatch cover lock 10 by the retainer hook 16, the seal is compressed slightly, creating an upward force on the hatch cover and hinge pin. Due to this force, the hinge pin 32 when secured by the retainer hook 16 engages the inner hook surface 44 of the upper hook portion 42.

Figure 6:
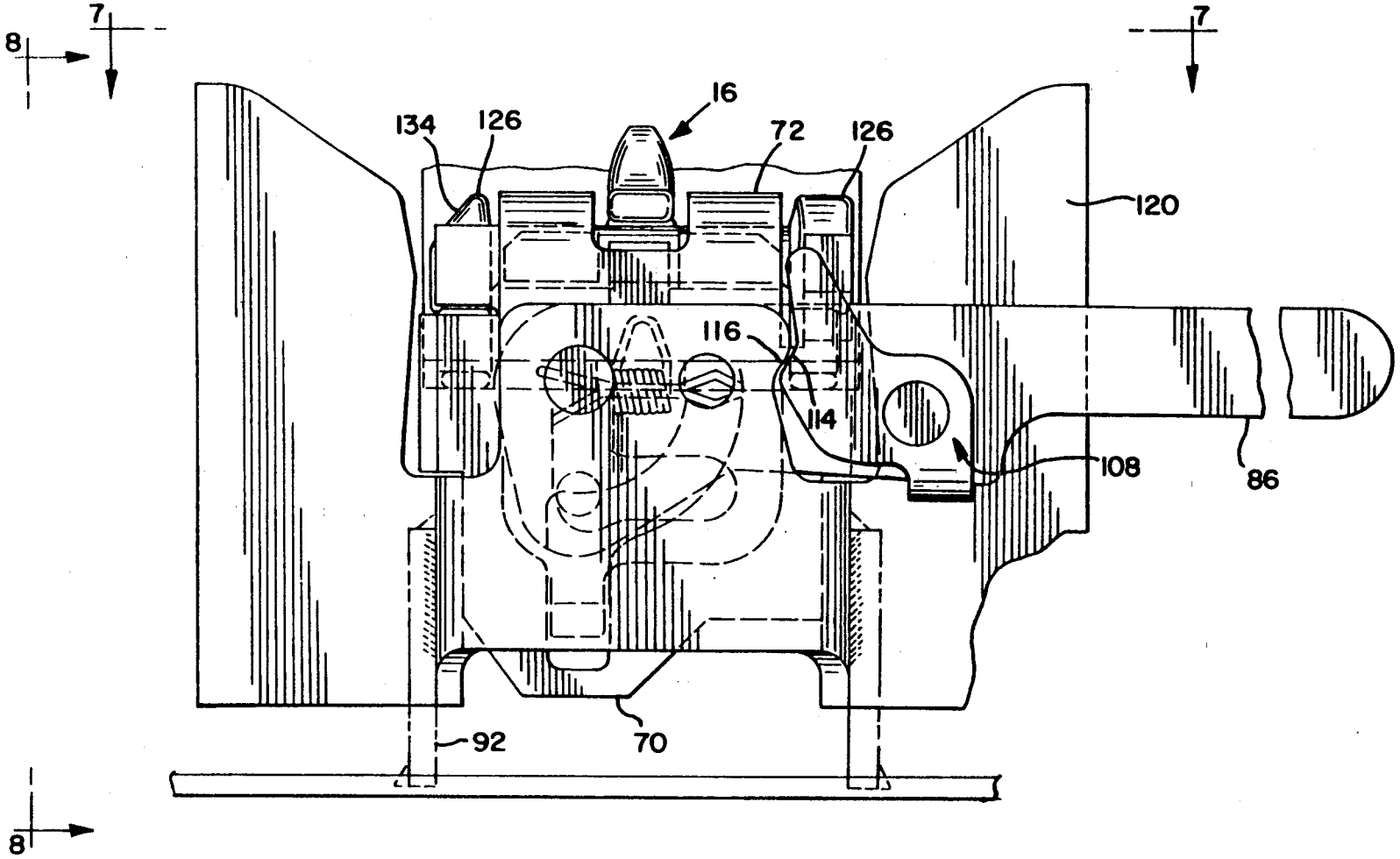
FIG. 6 is a front elevational view of a hatch cover lock made according to the present invention shown in the latched position.
Figure 7:
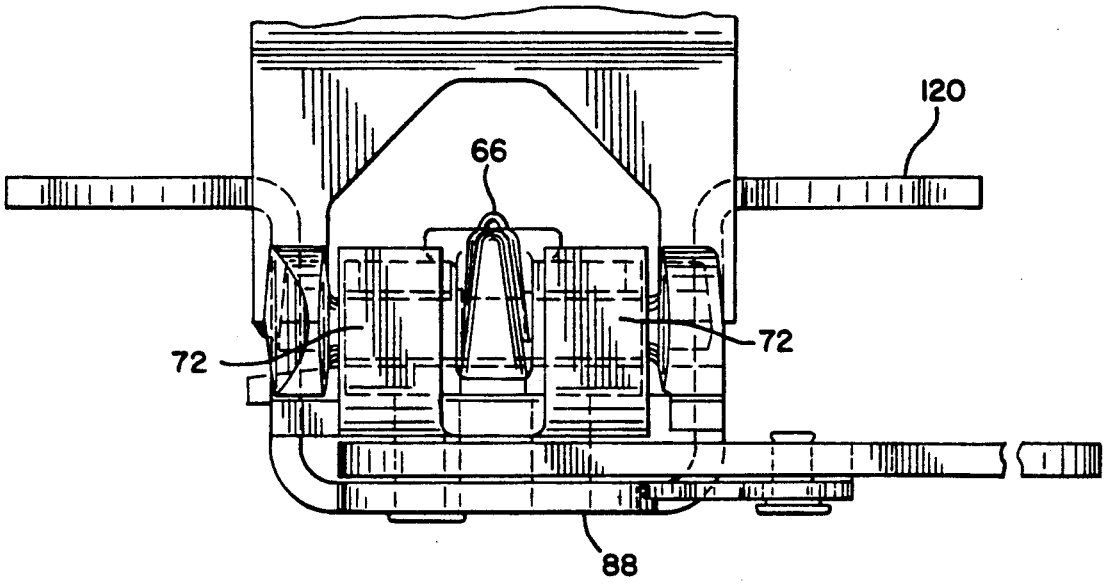
FIG. 7 is a top plan view of the hatch cover lock of FIG. 6.

The hinge pin 32 may be secured further by moving the handle 86 and thereby the keeper 18 to a position wherein cover straps 72 overly the saddle 34 on either side of the retainer hook 16 engaging the cylindrical pin body 124 as shown in FIGS. 6, 7 and 8. When the hinge pin is secured by the cover straps 72 the hinge pin is displaced downwardly further compressing the coming seal 132. The pin body 124 is displaced downwardly sufficiently to disengage the pin body from contact with the retainer hook 16. This prevents undue pressure from being exerted against the retainer hook 16 and prolongs the working life of the spring 60.

Figure 10:
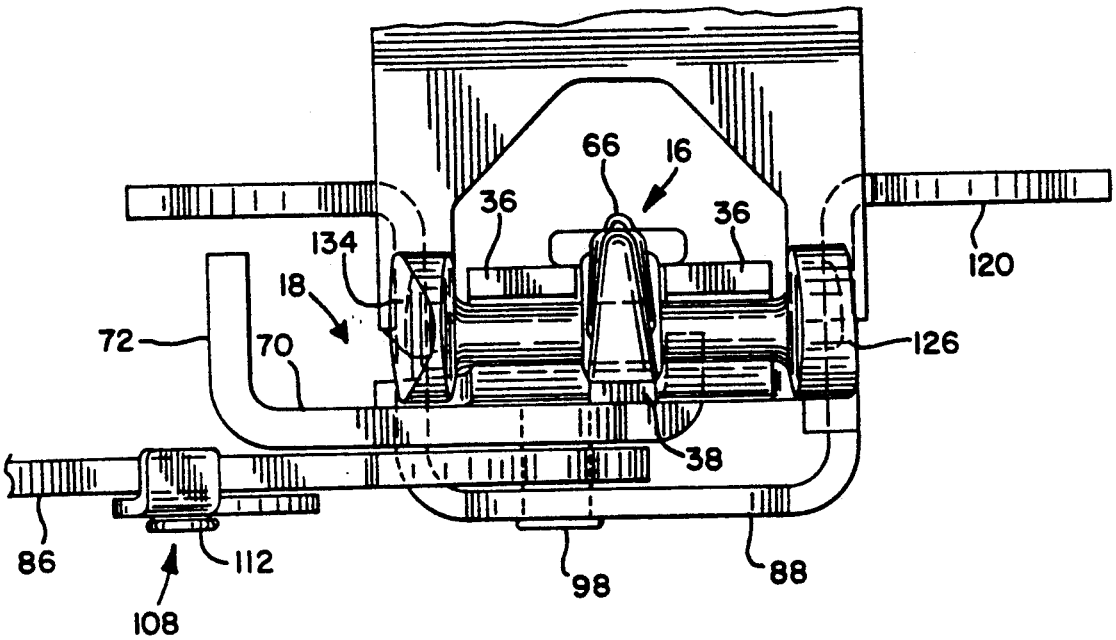
FIG. 10 is a top plan view of the hatch cover lock of FIG. 9.

To move from the latched position to the unlatched position the handle 86 is rotated causing the detent 106 which is located in the notch 82 to effect movement of the keeper. A shoulder 87 interconnects the notch 82 with the horizontal arm 80. As will appear hereafter the detent 106 occupies an over center relation with respect to the pivot member 98 when the handle 86 is in the latched position. A force must be exerted on the handle in order to move the detent 106 out of the over center position in the notch 82 and over the shoulder 87 in the horizontal arm 80 where it engages the undersurface thereof to effect first a vertical movement of the keeper 18 as guided by the follower flange 84 in the upwardly extending section 26 of the slot 24. As the detent moves along the horizontal arm and after the follower flange 84 has moved into the arcuate section 28 of the slot 24, the keeper 18 and cover straps 72 are pivoted so that the keeper is shifted vertically and arcuately out of overlying relation with respect to the saddle and finally reaches the position illustrated in FIGS. 9, 10 and 11 which is the unlatched position. On reverse pivotal movement of the handle 86 the detent 106 is pivoted back to its position in FIG. 6, the latched position.

In moving the keeper 18 between the latched and unlatched position, it should be noted that one of the cylindrical ends 126 of the hinge pin is chamfered 134 to allow the cover straps 72 to pass over the end of the hinge pin 32 when being rotated by the handle without obstructing its movement.

The retainer hook 16 is provided with a cut away portion 48 on its outer surface 46 that allows the hinge pin to rest thereon if the railroad personnel desires to unlock the hatch cover, but not open it. It is preferred that the retainer hook of a hatch cover lock include the cut away portion 48 when utilized to secure a hatch cover to the hopper car, but when the retainer hook 16 is utilized to retain a batten bar, no cut away portion on the retainer hook should be used due to the weight differences between the batten bar and hatch cover and to allow the hinge pin of the much lighter batten bar to slide into the saddle unfettered. The cut away portion 48 of the retainer hook 16 due to the force exerted by the torsion spring will support a hinge pin carried by a hatch cover without actuating the automatic locking means when the hatch cover is in a substantially lay flat configuration. This allows the personnel to go to another lock while preventing the hinge pin from sliding into the saddle.

In the event that a railroad personnel accidentally unlocks the hinges on both sides of a hatch cover and attempts to raise one side of the hatch cover 96, the hinge pins on the opposite side resting on the cut-away portion 48 will automatically be retained by the hook 16. As the hatch cover is raised, the force exerted by the hinge pin against the retainer hook is increased as the hatch cover approaches a vertical position overcoming the force supplied against the retainer hook 16 by the torsion spring 60 thereby snapping the hinge pin into a retained position.

It will thus be seen that the present invention provides a new and useful hatch cover lock for batten bars and hatch covers which has a number of advantages and characteristics including those pointed out herein and others which are inherent in the invention. A preferred embodiment of the invention having been described by way of example, it is anticipated that modifications may be made to the described form without departing from the spirit of the invention or the scope of the appended claims.

I claim:

1. A hatch cover lock for securing a removable roof member of a railway hopper car, one or more of the removable roof members, a hinge thereof or a batten bar therefor carrying a hinge pin, said hatch cover lock comprising:

means for housing the hatch cover lock and securing it to the railway hopper car;

a saddle associated with said means for housing, said saddle being adapted to receive the hinge pin;

first means for automatically providing access of said hinge pin into said saddle and for automatically securing said hinge pin within said saddle; and second means for securing said hinge pin within said saddle and for providing securement of said hinge pin within said saddle in addition to the automatic securing effected by said first means.

2. The hatch cover lock of claim 1, wherein said first means includes a hook member rotatably mounted to said means for housing and means for biasing said hook in a first position generally overlying said saddle, said first means being adapted to be pivoted to a second position allowing the hinge pin to ingress into and egress from said saddle.

3. The hatch cover lock of claim 2, wherein said hook member is rotatably mounted on a trunnion carried by said means for housing.

4. The hatch cover lock of claim 1, wherein said second means includes a lock mechanism carried on said means for housing, said lock mechanism including a keeper juxtaposed to said means for housing and having at least one generally laterally extending cover strap generally overlying said saddle, a handle pivoted between said keeper and said means for housing and cooperating with said keeper for shifting said cover strap between a latched position corresponding to a first position of said cover strap overlying said saddle and an unlatched position corresponding to a second position of said cover strap pivotally and transationally displaced from said first position of the cover strap.

5. The hatch cover lock of claim 1, wherein said first means includes a hook member rotatably mounted to said means for housing and means for biasing said hook in a first position generally overlying said saddle, said first means being adapted to be pivoted to a second position allowing the hinge pin to ingress into and egress from said saddle and wherein said second means includes a hatch lock mechanism carried on said means for housing, said hatch lock mechanism including a keeper juxtaposed to said means for housing and having at least one generally laterally extending cover strap generally overlying said saddle, a handle pivoted between said keeper and said means for housing and cooperating with said keeper for shifting said cover strap between a latched position corresponding to a first position of said cover strap overlying said saddle and an unlatched position corresponding to a second position of said cover strap pivotally and transationally displaced from said first position of the cover strap.

6. The hatch cover lock of claim 5, wherein said means for housing includes an inner housing and an outer housing rigidly secured together, said hook member is rotatably mounted to said inner housing, and the handle and the keeper are pivotally mounted between the inner housing and the outer housing.

7. A hatch cover lock for securing a removable hatch cover on a railway hopper car, the removable hatch cover carrying an offset hinge pin, said hatch cover lock comprising:

mounting means for mounting the hatch cover lock on said hopper car;

a saddle carried by said mounting means, said saddle adapted to receive the hinge pin;

first means for securing said hinge pin in said saddle, the first means including a hook member mounted for rotation with respect to said mounting means, said hook member being biased in a first position generally overlying said saddle and adapted to be pivoted to a second position allowing the hinge pin to ingress into and egress from said saddle; and second means for further securing said hinge pin in said saddle, said second means including a hatch lock mechanism carried on said mounting means, said hatch lock mechanism including a keeper juxtaposed to said mounting means and guided for translatory and pivotal movement thereon, said keeper having at least one laterally extending cover strap which generally overlies said saddle when the second means is in a latched position, a handle pivotally mounted on said mounting means between said keeper and said mounting means and cooperating with said keeper for shifting said cover strap between the latched position and an unlatched position where said cover strap is pivotally and transationally displaced from said latched position.

8. The hatch cover lock of claim 7, wherein the hinge pin includes cylindrical pin ends, one of said pins ends having a chamfered portion to allow said cover strap to be shifted between the unlatched and latched positions without interference when the hinge pin is disposed in said saddle.

9. The hatch cover lock of claim 7, wherein said hinge pin includes cylindrical pin ends having a downwardly extending flange with a cut away portion adapted to be connected to said hatch cover.

10. The hatch cover lock of claim 7, wherein said mounting means includes stabilizer bars for engaging and limiting transverse movement of said hinge pin when said hinge pin is seated in said saddle.

11. The hatch cover lock of claim 7, wherein said keeper has a pair of said laterally extending cover straps.

12. The hatch cover lock of claim 7, wherein said hook member includes a generally arcuate top surface.

13. The hatch cover lock of claim 7, wherein said hook member includes a generally convex top surface having a generally concave indentation adapted to accept the hinge pin when said hinge pin is in an unlocked position resting on said hook member.

14. The hatch cover lock of claim 7, wherein said hook member of the first means is biased by a torsion spring having two bearing surfaces engageable with said hook member.

15. The hatch cover lock of claim 7, wherein said mounting means includes an inner housing and an outer housing rigidly secured together, said hook member is rotatably mounted to said inner housing, and the handle and the keeper are pivotally mounted between the inner housing and the outer housing.

16. A hatch cover lock for securing a batten bar on a hopper car, the batten bar having a hinge pin for securing the batten bar to the hopper car, said hatch cover lock comprising:

mounting means for mounting the hatch cover lock on said hopper car;

a saddle carried by said mounting means, the saddle adapted to receive the hinge pin of the batten bar;

first means for securing said hinge pin in said saddle, said first means including a hook member mounted for rotation with respect to said mounting means, said hook member being biased in a first position generally overlying said saddle and adapted to be pivoted to a second position allowing the hinge pin to ingress into and egress from said saddle;

second means for further securing said hinge pin in said saddle, said second means including a lock mechanism carried on said mounting means, said lock mechanism including a keeper juxtaposed to said mounting means and guided for translatory and pivotal movement thereon, said keeper having at least one laterally extending cover strap generally overlying said saddle when the second means is in a latched position, a handle pivotally mounted on said mounting means between said keeper and said mounting means, said handle cooperating with said keeper for shifting said cover strap between the latched position and an unlatched position where said cover strap is pivotally and transationally displaced from the latched position; and centering means for centering the batten bar and guiding the hinge pin into said saddle.

17. The hatch cover lock of claim 16, wherein siad hinge pin includes cylindrical pin ends, one of said ends having a chamfered portion to allow said cover strap to be shifted between the unlatched and latched positions without interference when the hinge pin is disposed in said saddle.

18. The hatch cover lock of claim 16, wherein said hinge pin includes cylindrical pin ends having a downwardly extending flange with a cut away portion adapted to be connected to said batten bar.

19. The hatch cover lock of claim 16, wherein said mounting means includes stabilizer bars for engaging said hinge pin when said hinge pin is seated in said saddle.

20. The hatch cover lock of claim 16, wherein said keeper has a pair of said laterally extending cover straps.

21. The hatch cover lock of claim 16, wherein said hook member includes a generally arcuate top surface.

22. The hatch cover lock of claim 16, wherein said hook member includes a generally convex to surface having a cut away portion adapted to accept the hinge pin when said hinge pin is in an unlocked position resting on said hook member.

23. The hatch cover lock of claim 16, wherein said hook member of the first means is biased by a torsion spring having two bearing surfaces engageable with said hook member.

24. The hatch cover lock of claim 16, wherein said mounting means includes an inner housing and an outer housing rigidly secured together, said hook member is rotatably mounted to said inner housing, and the handle and the keeper are pivotally mounted between the inner housing and the outer housing.

25. The hatch cover lock of claim 16, wherein said centering means includes a pair of spaced apart plates attached to said mounting means, each of said plates having a downwardly and inwardly angled cam surface for engaging the batten bar and directing its hinge pin to the saddle.

* * * * *

UNITED STATES PATENT AND TRADEMARK OFFICE

CERTIFICATE OF CORRECTION

PATENT NO. : 5,314,218

DATED : May 24, 1994

INVENTOR(S) : Rudolph E. Nadherny

It is certified that error appears in the above-indentified patent and that said Letters Patent is hereby corrected as shown below:

Col. 1, line 57, delete --to--.

Col. 2, line 5, "Potential safety problem" should read --potential safety problems--.

Col. 5, line 2, "Of" should read --of--; line 13, "ar" should read --arm--; line 16, "Planar" should read --planar--; line 18, "Pivotally" should read --pivotally--; line 20, "Position and an unlatched Position." should read --position and an unlatched position.--; line 26, "goo." should read --90°--.

Col. 11, line 12, "siad" should read --said--.

Col. 12, line 7, "to" should read --top--.

Signed and Sealed this

Eighth Day of November, 1994

*Attest:*

*Attesting Officer*

BRUCE LEHMAN

*Commissioner of Patents and Trademarks*